United States Patent [19]

Goldsworthy

[11] 4,014,050

[45] Mar. 29, 1977

[54] APPARATUS EMPLOYING A TIMER FOR CONTROLLING THE QUANTITY OF WATER FLUSHED BY A TOILET

[76] Inventor: Forrest C. Goldsworthy, 2595 Aragon Court, San Jose, Calif. 95125

[22] Filed: Apr. 15, 1976

[21] Appl. No.: 677,224

[52] U.S. Cl. ..... 4/67 A; 4/100

[51] Int. Cl.[2] ..... E03D 1/34; E03D 5/02; A61B 19/00

[58] Field of Search ..... 4/67 A, 67 R, 52, 57 R, 4/34, 100, 101

[56] References Cited

UNITED STATES PATENTS

| | | | |
|---|---|---|---|
| 2,635,691 | 4/1953 | Filliung | 4/100 UX |
| 3,034,151 | 5/1962 | Filliung | 4/249 |
| 3,365,730 | 1/1968 | Chiappetta | 4/67 A |
| 3,787,902 | 1/1974 | McCombs | 4/67 A |
| 3,902,201 | 9/1975 | Bobo | 4/67 A |

*Primary Examiner*—Henry K. Artis
*Attorney, Agent, or Firm*—Boone, Schatzel, Hamrick & Knudsen

[57] ABSTRACT

An apparatus for controlling the quantity of water flowing through a water outlet in the tank of a toilet comprising a timer including a rotatable output shaft, the timer being responsive to the angular rotation of the shaft from an initial position and operative to return the shaft to the initial position after a time duration corresponding to the amount of angular rotation of the shaft, a crank coupled to the shaft and being capable of rotating the shaft through a predetermined angle when a force is applied to it, a mounting assembly for mounting the timer to the tank, and a mechanical linkage coupled between the shaft and a lift rod in the tank for moving the lift rod a dimension such that a valve is unseated when the shaft is not in the initial position, and the valve is seated when the shaft is in the initial position, whereby when a force applied to the crank rotates the crank and hence the shaft through the predetermined angle the linkage is moved a dimension sufficient to unseat the valve from the water outlet causing water to flow through the water outlet, and whereby the return of the shaft to said initial position causes the linkage to seat the valve on the water outlet after a time duration corresponding to the predetermined angle, the time duration serving to control the quantity of water flowing out of the tank.

11 Claims, 4 Drawing Figures

APPARATUS EMPLOYING A TIMER FOR CONTROLLING THE QUANTITY OF WATER FLUSHED BY A TOILET

BACKGROUND OF THE INVENTION

1. Field of the Invention

The present invention relates generally to apparatus for controlling the outflow of the flushing water into a toilet bowl, and more particularly, to such an apparatus that employs a mechanical timer and a crank for selectively controlling the quantity of water flushed.

2. Description of the Prior Art

Conventional toilet tanks generally contain between five and six gallons of water and utilize substantially all of such water during a flushing operation. It has been recognized that the use of such large quantities of water in all instance is not necessary since the flushing away of waste liquids requires only a fraction of the water required for flushing solid matter. For example, it has been determined that approximately seven quarts of water is sufficient to remove liquid waste whereas about 3½ gallons of water is sufficient to remove solid waste. In view of such waste and because of the interest of society in preserving our natural resources water conservation legislation is presently being enacted in several of the states.

In the patent art, mechanisms for providing a partial flush or a full flush are disclosed in U.S. Pat. No. 3,093,833, "Two-Way Flush Valve Mechanism" by Romeo M. Nardone and in U.S. Pat. No. 3,745,591, "Toilet Flushing Mechanism" by William Girten. Each of the mechanisms, however, relies on the weight of the water in the tank to cause the bulb valve to seat on the water oulet. This is disadvantageous since the time required for seating may vary. These patents do not reveal an apparatus that utilizes a timer for forcing the valve to be seated on the water outlet after a predetermined time has elapsed.

SUMMARY OF THE INVENTION

It is therefore a primary object of the present invention to provide an improved apparatus for controlling the quantity of water flowing through the outlet in a toilet tank.

Another object of the present invention is to accomplish the previously stated object by employing a timer having a rotatable output shaft that is coupled to the valve and which serves to positively seat the valve on the water outlet after a preselected time duration.

Yet another object of the present invention is to provide such an apparatus having a dial-like crank for rotating the output shaft of the mechanical timer through one of two preselected angles which correspond to a partial or full flush of the toilet.

Briefly, the preferred embodiment includes a timer including a rotatable output shaft, the timer being responsive to the angular rotation of the shaft from an initial position and operative to return the shaft to the initial position after a time duration corresponding to the amount of the angular rotation of the shaft, a crank coupled to the shaft and being capable of rotating the shaft to a predetermined angle when a force is applied to it, a mounting assembly for mounting the timer to the tank, and a linkage assembly coupled between the shaft and a valve which is seatably disposed on the water outlet in a toilet tank, the linkage assembly serving to raise and unseat the valve when the shaft is not in the initial position, whereby when a force applied to the crank rotates the crank and hence the shaft through the predetermined angle, the linkage assembly raises and unseats the valve from the water outlet causing water to flow through the water outlet, and whereby the return of the shaft to the initial position causes the linkage assembly to force the valve downward until it is seated on the water outlet after a time duration corresponding to the predetermined angle, the time duration serving to control the quantity of water flowing out of the tank. In one embodiment, the distal end of the crank is bifurcated so as to form two fingers and a stop is provided in the path of the fingers to control the angle of rotation of the crank.

Among the important advantages of the present invention is that it provides a means by which a relatively small amount of flushing water ca.. be used when it is desired to flush away only fluids, and an increased amount of the water can be used when it is desired to flush away some solid matter.

Another advantage of the present invention is that it includes a timer which serves to positively seat the valve on the water outlet after a predetermined time interval has elapsed.

These and other objects and advantages of the present invention will no doubt become apparent following a reading of the detailed description of the preferred embodiments which are illustrated in the several figures of the drawing.

IN THE DRAWING

DETAILED DESCRIPTION OF THE PREFERRED EMBODIMENTS

Figure 1:
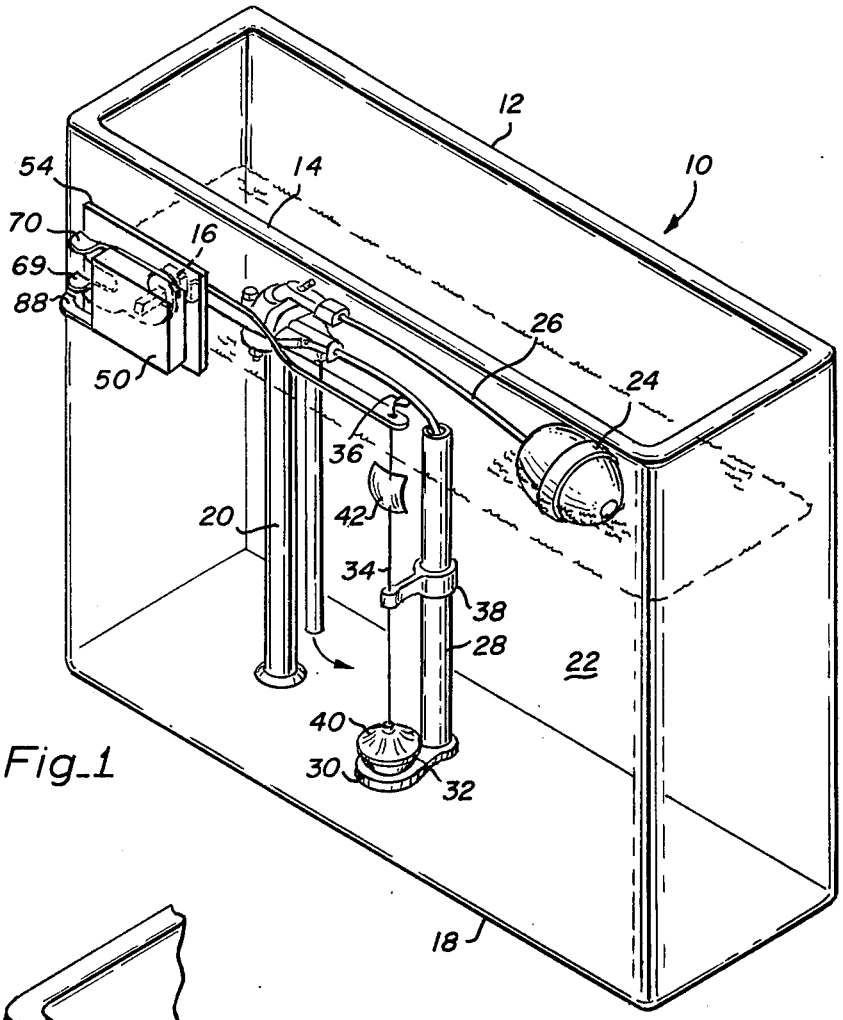
FIG. 1 is a perspective view of an apparatus for controlling the quantity of water flow in accordance with the present invention.

Referring now to FIG. 1 of the drawing, an apparatus 10 for controlling the quantity of water flowing through an outlet in the tank of a toilet in accordance with the present invention is illustrated in a perspective view.

As shown, the tank on which the apparatus 10 is installed is a conventional water-holding tank having a front wall 14 with a square hole 16 through its upper lefthand corner and a bottom wall 18. A fill tube 20 extends through the bottom wall and serves as an inlet for water, generally illustrated by the numeral 22, flowing into the tank. A ball float 24 depending from a rod 26 affixed to the fill tube 20 serves to control the level of the water allowed to enter the tank in a manner which is well known to those skilled in the art. An overflow tube 28 also extends through the bottom wall and provides a path for the overflowing water to escape should it reach a level above that of the ball float 24. An outlet 30 forming a seat 32 permits the flow of water out of the tank and into the toilet bowl (not shown). A lift rod 34 having a flanged upper portion 36 and a threaded lower portion is slideably mounted relative to the overflow tube 28 by a guide 38. A bulb valve 40 is attached to the threaded lower portion of the lift rod 34 and is disposed so as to be normally seated on the seat 32. The bulb valve 40 serves to prevent the flow of water into the toilet bowl when so seated over the water outlet 30. A stop 42 is disposed around the lift rod 34 below the flange 36.

Figure 2:
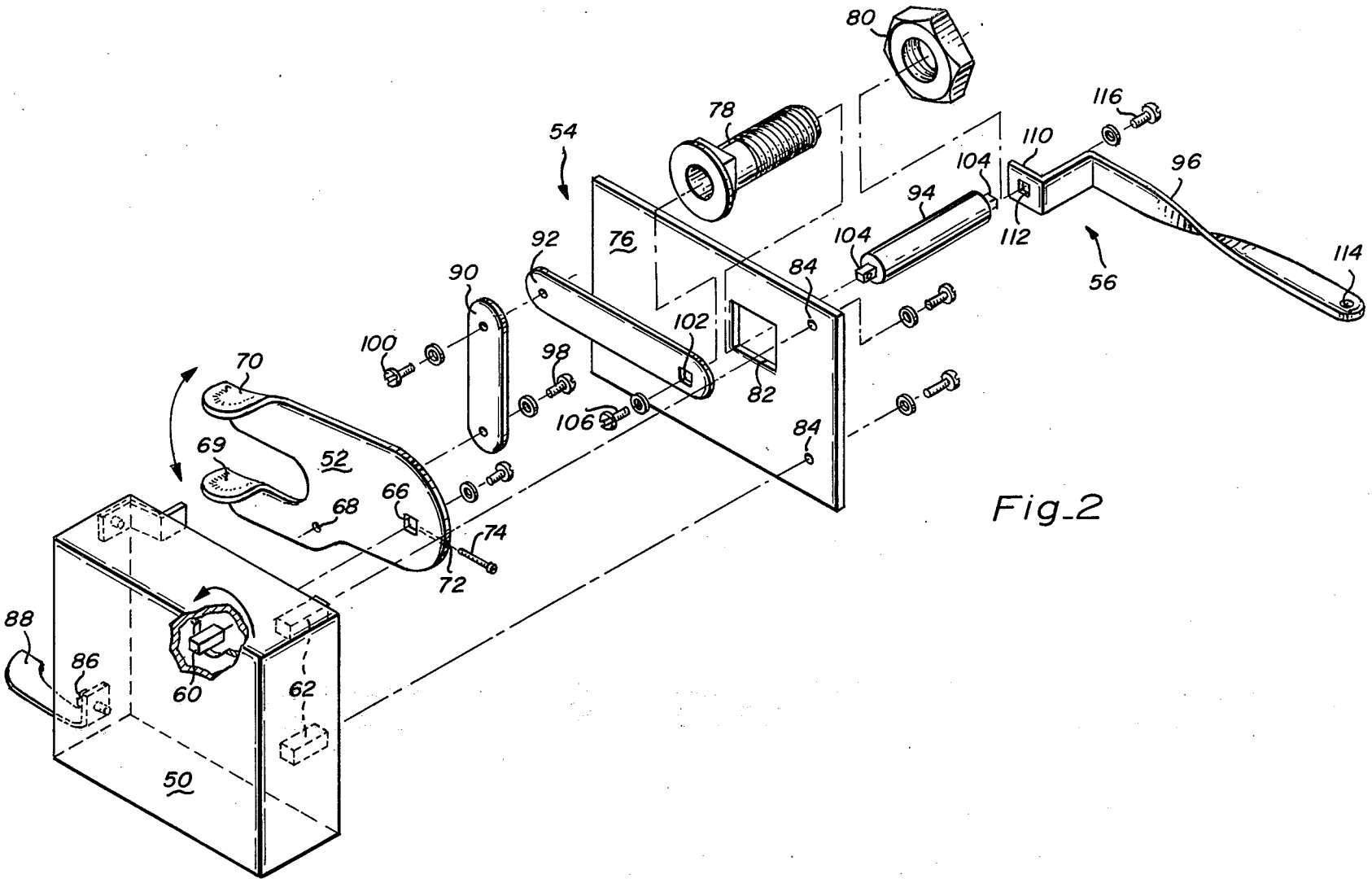
FIG. 2 is an exploded perspective view of the apparatus of FIG. 1.

Referring also to FIG. 2, which illustrates the parts of the apparatus 10 in an exploded perspective view, the apparatus comprises a mechanical timer 50, a crank 52, a mounting assembly 54 for mounting the mechanical timer 50 to the tank 12 and a mechanical linkage 56.

The mechanical timer 50 includes those components required to perform the normal mechanical timing functions accomplished by standard music box motors, alarm clocks or the like. For example, it may include such components as a spring, a ratchet gear mechanism, etc. The timer 50 includes a square rotatable output shaft 60 and a pair of threaded spacers 62 and responds to the angular rotation of its output shaft from an initial position by rotating the shaft in the opposite direction at a constant angular velocity of 4 rpm until the shaft returns to its initial position. The time duration for the shaft to return to its initial position corresponds to the amount of the angular rotation of the shaft. In the preferred embodiment the mechanical timer is one manufactured by the Lador Manufacturing Company of Switzerland.

Alternatively, a pneumatic timer of the conventional type which includes an air chamber, a spring return piston for compressing the air to dissipate at an adjustable rate, and a rotatable output shaft which is selectively rotated to correspond to the time delay as determined by the adjustment of the bleed valve may be employed in place of the mechanical timer.

The crank 52 is an elongated member having a square key hole 66, a threaded opening 68 and a bifurcated end forming two separated fingers 69 and 70. The fingers 69 and 70 have generaly planar upper surface that are shaped to conform to the fingers of the person operating the device. A threaded hole 72 communicates with the hole 66 and is adapted to receive a set screw 74 for locking the crank to the output shaft of the timer.

The mounting assembly 54 comprises a generally rectangular mounting plate 76, a hollow mounting sleeve 78 and a nut 80. The mounting plate 76 is adapted to be secured to the front wall 14 and includes a square hole 82 in alignment with the hole 16 and mounting holes 84 for receiving the ends of the spacers 62 and screw 86. The screw 86 secures stop 88 to the front face of the timer 50. The sleeve 78 is a type of hollow shoulder screw having a square shoulder and a threaded shank. The square shoulder serves to mate with the inner periphery of the hole 82, while the shank extends through the hole 16. The nut 80 secures the mounting plate 76 to the tank 12.

The mechanical linkage 56 includes elongated links 90 and 92, a rotatable drive shaft 94 and an arm 96. The link 90 has a first end pivotally secured to the hole 68 in the crank 52 with a screw 98 and an opposed end pivotally secured to the link 92 with a screw 100. The free end of the link 92 includes a square key hole 102. The drive shaft 94 has an axial length substantially the same as that of the sleeve 78 and a diameter slightly less than that of the sleeve after the mounting plate is secured to the tank. Square key pins 104 having threaded holes protrude from each end of the shaft 94. One of the pins 104 extends into the key hole 102 and is secured thereto by a screw 106. The arm 96 includes an end 110 having a key hole 112, a center portion bent at a right angle relative to the end 110 and an elongated portion twisted so that a hole 114 in its end is generally normal to the hole 112. A screw 116 secures the end 110 to the pin 104. The lift rod 34 is slideably mounted through the hole 114 between the flange 36 and the stop 42.

As assembled, the mounting plate 76 abuts the front wall 14 of the tank 12 with the holes 16 and 82 in substantial alignment. The mounting sleeve 78 is inserted through the hole 16 and 82 and secured in place by the nut 80. The drive shaft 94 extends through the hollow interior of the sleeve 78. The links 90 and 92 are pivotally secured between the crank 52 and the drive shaft 94 by the screws 98 and 106, respectively. The crank 52 is keyed to the rotatable shaft 60 of the timer 50, and the timer 50 is affixed to the mounting plate 76 with screws (not shown) which are inserted into the ends of the spacers 62. The stop 88 is mounted to the timer 50 such that it defines a reference surface which serves to receive the fingers 69 and 70 when the crank is rotated, and to limit the movement of the hand of the user when the finger 69 or 70 is disposed against the stop 88.

In operation, when a partial flush is desired, the user pushes down the finger 69 with his hand until the finger 69 is received by the stop 88 which in turn stops the downward movement and restrains the movement of the fingers of his hand. This causes the crank 52 and hence the output shaft 60 to rotate through an angle of about 22.5°. The rotation of the shaft drives the links 90 and 92, the drive shaft 94 and the arm 96. As the arm 96 rotates upwardly its end engages the flange 36. Continued movement causes the lift 34 to raise which in turn unseats the bulb valve 40 from the seat 32. As a result the water 22 blows through the outlet 30 into the toilet bowl, thereby causing a flushing of the toilet. After the winding of the crank is stopped, the shaft 60 actuates the mechanical timer 50 which then rotates the shaft in an opposite direction back toward its initial position. This forces the mechanical linkage 56 against the stop 42 and causes the lift rod 34 to move downward until the bulb valve 40 is again seated over the outlet 30, terminating water flow into the toilet.

In the preferred embodiment the 22.5° rotation of the shaft allows the water outlet to remain open for about 2½ seconds. It has been found that this time allows about 7 quarts of water to flush into the toilet, which amount is sufficient to cause a complete flushing of urine or other water waste from the toilet.

Figure 3:
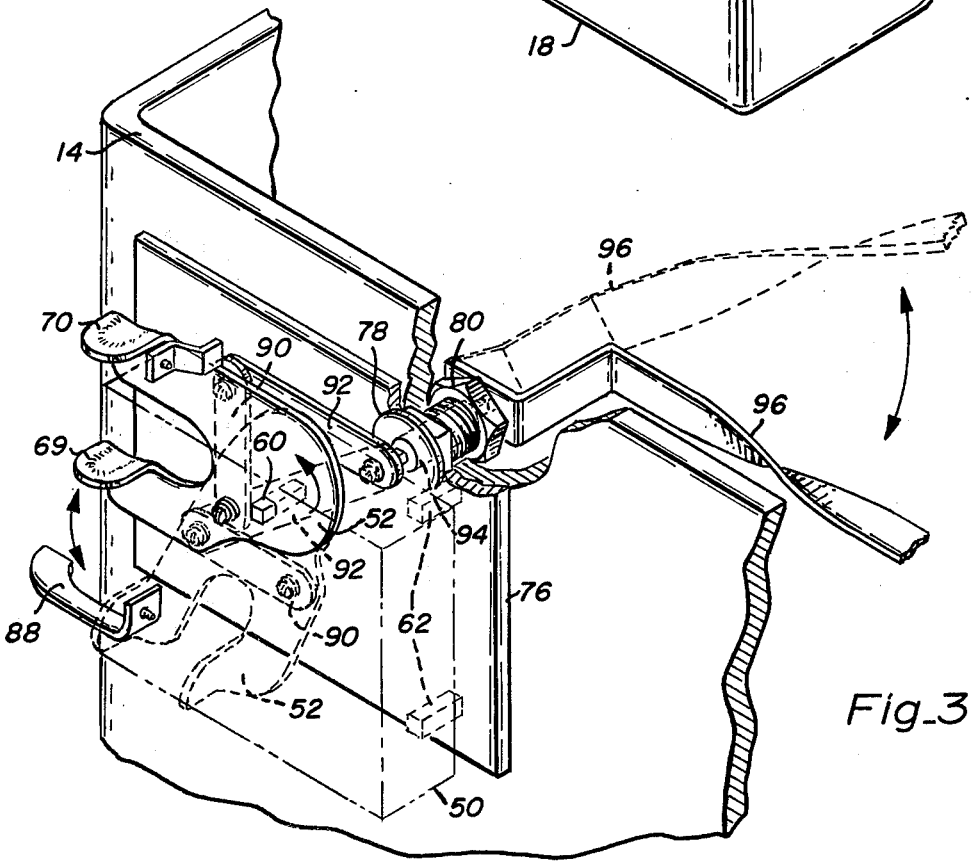
FIG. 3 is schematic diagram illustrating the operation of the apparatus of FIG. 1 with the timer removed.

When a normal flush is desired, the user depresses the finger 70. The operation of the present invention is similar to that just described. In normal flush the output shaft is rotated through an angle of about 45° as illustrated in FIG. 3 which keeps the bulb valve unseated for about 5 seconds and allows about 4 gallons of water to be flushed.

Figure 4:
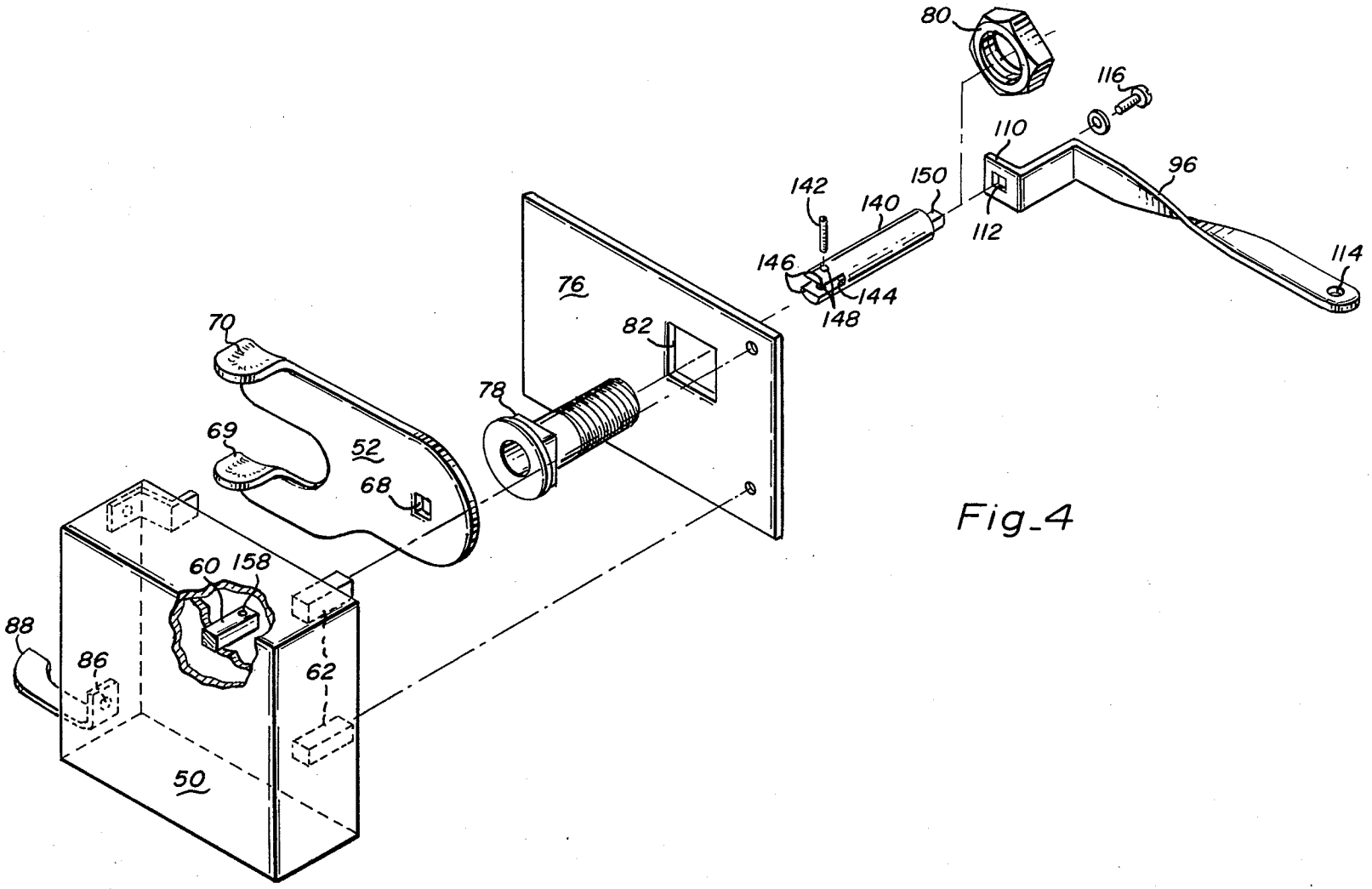
FIG. 4 is an exploded perspective view of an alternative embodiment of the present invention.

An alternative embodiment of the present invention is illustrated in an exploded perspective view in FIG. 4. As illustrated many of the parts are identical to those of FIG. 2 and accordingly have been identified with like numerals. The fundamental difference of the embodiment illustrated in FIG. 4 is that the links 90 and 92 and the shaft 94 have been replaced with a shaft 140 and a pin 142. In addition, the mechanical timer 50 includes a square shaft 60 having a hole aperture 158 therethrough.

The shaft 140 is generally cylindrical in shape and has a slot 144 formed in an end, thereby providing bifurcated arms 146 having aligned holes 148 therethrough. Its opposed end includes a generally square key pin 150 having a threaded hole which is keyed to the hole 112 in the end 110 of the arm 96 by a screw 116. In assembly, the arms 146 extend through the opening 66 in the crank 52 and over the horizontal surfaces of the output shaft 60 with its holes 148 in alignment with a vertical hole 158 through the output shaft 60. The pin 142 is disposed through the holes 148 and 158 and thus secures the shaft 140 to the timer 50.

The operation of the apparatus of the embodiment shown is similar to that previously described.

Although not shown, it should be recognized that the present invention can be used with flapper and American Standard type of valve arrangements and also can be mounted inside the tank.

From the above, it can be seen that an improved apparatus for controlling the quantity of water through the outlet in a tank and hence the flushing of a toilet has been described which fulfills all of the objects and advantages set forth above.

Although the invention has been particularly shown and described with reference to certain perferred embodiments, it will be understood by those skilled in the art that various alterations and modifications in form and detail may be made therein. Accordingly, it is intended that the following claims cover all such alternations and modifications as fall within the true spirit and scope of the invention.

What is claimed is:

1. In a toilet including a tank having a water outlet, a valve seatably disposed on the water outlet and a lift rod attached to the valve an improved apparatus for controlling the quantity of water flowing through the outlet comprising:

a timer including a rotatable output shaft, said timer being responsive to the angular rotation of said shaft from an intitial position and operative to return said shaft to said initial position after a time duration corresponding to the amount of angular rotation of said shaft;

a crank coupled to said shaft and being capable of rotating said shaft through a predetermined angle when a force is applied to it;

means mounting said timer to the tank; and means coupled between said shaft and the lift rod for moving the lift rod a dimension such that the valve is unseated when said shaft is not in said initial position, and said valve is seated when said shaft is in said initial position, whereby when a force applied to said crank rotates said crank and hence said shaft through said predetermined angle said means coupled between said shaft and the lift rod is moved a dimension sufficient to unseat the valve from the water outlet causing water to flow through the water outlet, and whereby the return of said shaft to said initial position causes said means coupled between said shaft and the lift rod to seat the valve on the water outlet after a time duration corresponding to the predetermined angle, said time duration serving to control the quantity of water flowing out of the tank.

2. An improved apparatus as recited in claim 1 wherein said timer is a mechanical timer and said crank is secured to said shaft.

3. An improved apparatus as recited in claim 1 wherein the distal end of said crank includes at least two fingers extending outwardly therefrom and further comprising a stop disposed adjacent the path of said fingers for stopping the rotation of said crank at an angle corresponding to each said finger whereby when the person flushing the toilet depresses one of said fingers, the crank is rotated until said finger is moved adjacent said stop which stops the angular rotation of said crank and limits the water flowing out of the tank to an amount corresponding to which of said fingers is depressed.

4. An improved apparatus as recited in claim 3 wherein said crank includes first and second fingers.

5. An improved apparatus as recited in claim 4 wherein said first finger is rotatable through an angle of about 22.5° and said second finger is rotatable through an angle of about 45°.

6. An improved apparatus as recited in claim 3 wherein said stop is mounted to said timer.

7. An improved apparatus as recited in claim 3 wherein said means coupled between said shaft and the lift rod includes a first link pivotally coupled to said crank, a second link having an end pivotally connected to said first link and an opposed end, a coupling shaft having a first end secured to said opposed end and a second end, and an arm pivotally secured between said second end and the lift rod, whereby rotation of said output shaft is transmitted through said first and second links and said coupling shaft to said arm, causing said arm to pivot the lift rod.

8. An improved apparatus as recited in claim 7 wherein the front wall of the tank has a hole therethrough and said means mounting said mechanical timer to the tank includes a mounting plate having an opening therethrough mounted such that said opening is aligned with said hole, and a hollow mounting sleeve extending through said hole and said opening, said sleeve serving to rotatably carry said coupling shaft.

9. An improved apparatus as recited in claim 3 wherein said means coupled between said shaft and the lift rod includes a drive shaft and an arm having first and second ends, said drive shaft being between said output shaft and said first end, said second end being slideably connected to the lift rod, whereby rotation of said output shaft is transmitted through said drive shaft to said arm, causing said arm to raise and lower the lift rod.

10. An improved apparatus as recited in claim 9 wherein the front wall of the tank has a hole therethrough and said means mounting said mechanical timer to the tank includes a mounting plate having an opening therethrough and a hollow mounting sleeve, said plate being mounted to the front wall such that said opening and said hole are aligned, said hollow sleeve extending through said hole and said opening and serving to rotatably carry said coupling shaft.

11. An improved apparatus as recited in claim 1 wherein said output shaft has a generally square cross section and said crank includes a generally square opening which serves to receive said output shaft while limiting relative movement therebetween.

* * * * *